United States Patent [19]

Mrotz, III

[11] Patent Number: 4,818,019

[45] Date of Patent: Apr. 4, 1989

[54] TILT CONTROL MECHANISM, PARTICULARLY FOR KNEE-TILT CHAIR

[75] Inventor: Walter C. Mrotz, III, North Muskegon, Mich.

[73] Assignee: Haworth, Inc., Holland, Mich.

[21] Appl. No.: 12,571

[22] Filed: Feb. 9, 1987

[51] Int. Cl.[4] ..... A47C 3/00

[52] U.S. Cl. ..... 297/303; 248/575; 248/596; 297/304; 297/326

[58] Field of Search ..... 297/302, 303, 304, 305, 297/325, 326; 248/566, 575, 596, 608, 372.1

[56] References Cited

U.S. PATENT DOCUMENTS

| | | | |
|---|---|---|---|
| 581,762 | 5/1897 | Neuens . | |
| 1,267,792 | 5/1918 | Oliver | 297/302 |
| 1,747,932 | 2/1930 | Dufaux . | |
| 2,087,253 | 7/1937 | Herold | 248/575 X |
| 2,095,947 | 10/1937 | Herold . | |
| 2,167,508 | 7/1939 | Herold | 248/575 X |
| 2,362,746 | 11/1944 | DeVries . | |
| 2,365,200 | 12/1944 | Lorenz . | |
| 2,606,592 | 8/1952 | McIntyre . | |
| 2,619,153 | 11/1952 | Osselen . | |
| 2,633,897 | 4/1953 | Moore | 297/326 X |
| 2,840,140 | 6/1958 | Harrington . | |
| 3,493,211 | 2/1970 | Barecki et al. . | |
| 3,504,881 | 4/1970 | Pillons et al. . | |
| 3,627,252 | 12/1970 | Yamaguchi . | |
| 3,659,819 | 5/1972 | Wolters | 297/304 X |
| 3,740,792 | 6/1973 | Werner | 297/304 X |
| 3,814,369 | 6/1974 | Kastholm et al. | 248/596 X |
| 3,881,772 | 5/1975 | Mohrman . | |
| 4,235,408 | 11/1980 | Sapper | 248/608 |
| 4,384,741 | 5/1983 | Flum et al. | 297/304 |
| 4,529,247 | 7/1985 | Stumpf et al. . | |
| 4,575,151 | 3/1986 | Edstrom | 297/304 |
| 4,652,050 | 3/1987 | Stevens | 297/304 X |
| 4,653,806 | 3/1987 | Willi . | |
| 4,666,121 | 5/1987 | Choong et al. . | |

FOREIGN PATENT DOCUMENTS

| | | | |
|---|---|---|---|
| 490970 | 3/1953 | Canada . | |
| 933492 | 9/1955 | Fed. Rep. of Germany . | |
| 1554058 | 3/1970 | Fed. Rep. of Germany . | |
| 656782 | 5/1929 | France . | |
| 197529 | 5/1923 | United Kingdom | 297/305 |
| 656957 | 9/1951 | United Kingdom . | |
| 785194 | 10/1957 | United Kingdom . | |

OTHER PUBLICATIONS

Herman Miller Brochure: "Equa A Chair For People Who Can't Sit Still", 1984, 16 page.

Herman Miller Brochure: "Equa Seating", 1985, 16 pages.

Herman Miller Brochure: "We Hope You Enjoy Your New Equa Chair", 1984, 1 page.

Herman Miller Magazine: "From Equa Seating to Seafood Linguini", pp. 31–36.

*Primary Examiner*—Peter A. Aschenbrenner
*Assistant Examiner*—Thomas A. Rendos
*Attorney, Agent, or Firm*—Flynn, Thiel, Boutell & Tanis

[57] ABSTRACT

The seat and pedestal of a chair are joined by a knee-tilt control mechanism which includes a first support fixed to the underside of the seat adjacent the front edge thereof, and a second support fixed to the upper end of the pedestal and having a sidewardly extending tube. The first support has bearing hubs which are rotatably engaged with the tube to define a horizontal tilt axis. A restoring mechanism is disposed within the tube for exerting a restoring torque urging the seat upwardly into a horizontal position. The restoring mechanism employs compression springs within the tube on axially opposite sides of a pre-torque member which can be rotated to adjust the initial spring compression. The springs bear against actuators which rotate with the bearing hubs. The actuators have radially projecting followers for engagment with ramp-like cams formed circumferentially of the tube. When the seat is tilted rearwardly, the followers ride against the cam ramps and cause the actuators to be displaced axially to increase the spring compression in accordance with the cam profile. The cams have a nonlinear profile so that the spring compression and restoring torque increases at a first rate throughout the initial tilt angle, such as from 0° to 5°, which rate decreases throughout the remaining tilt.

12 Claims, 2 Drawing Sheets

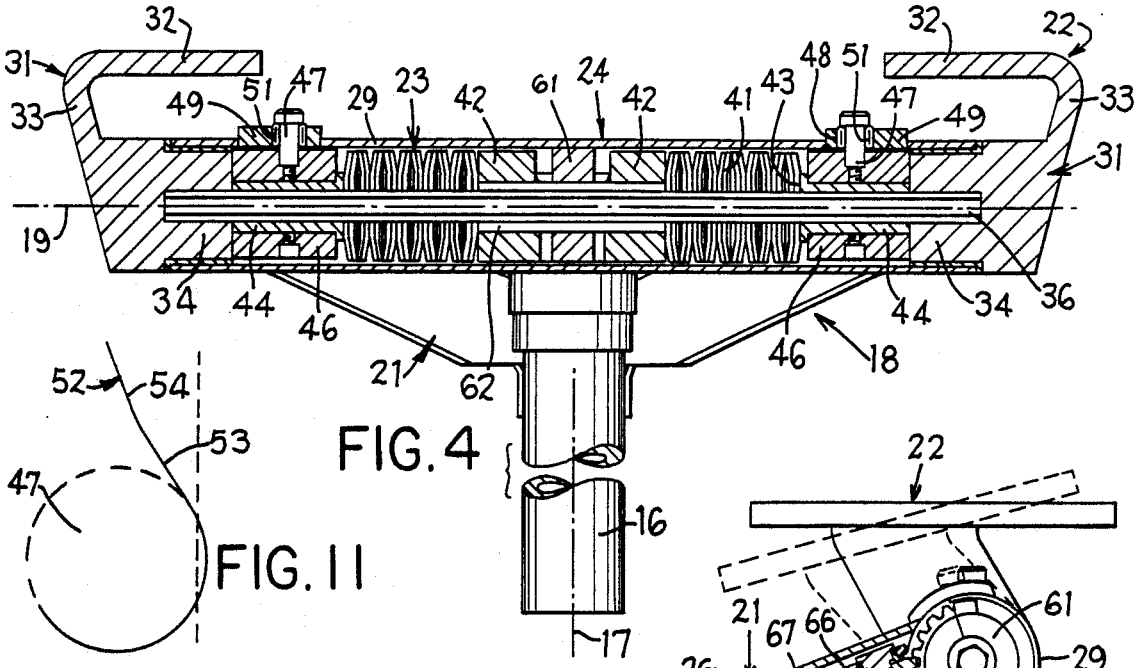
FIG. 4
FIG. 11
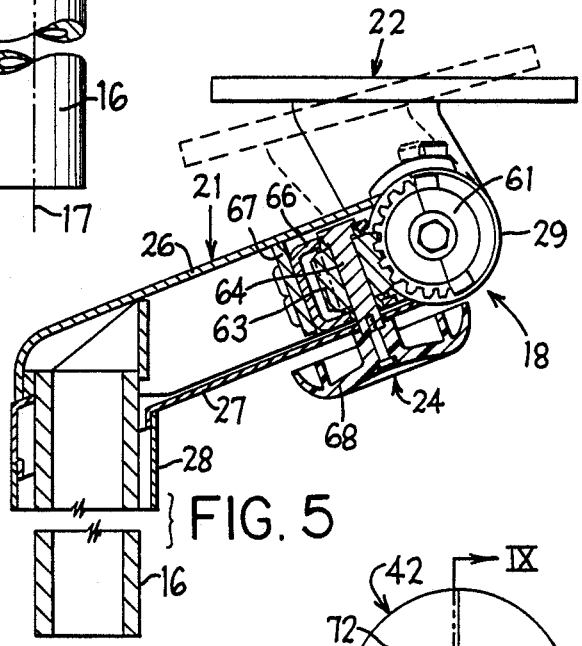
FIG. 5
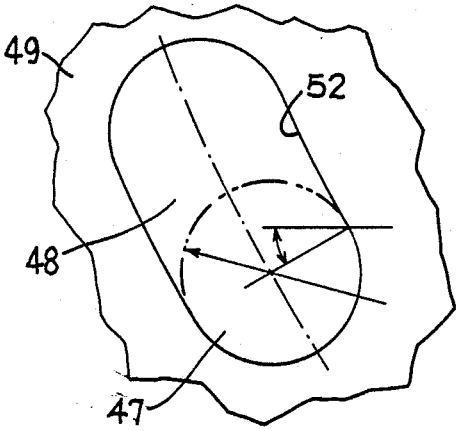
FIG. 10
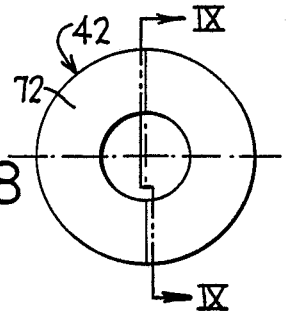
FIG. 8
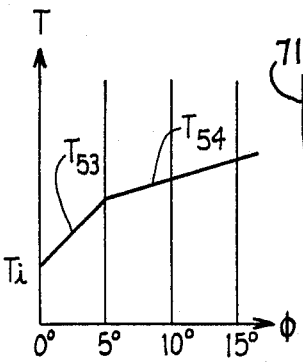
FIG. 12
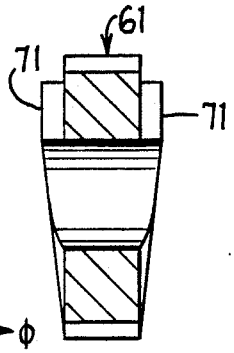
FIG. 7
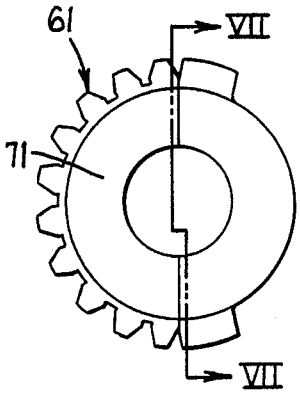
FIG. 6
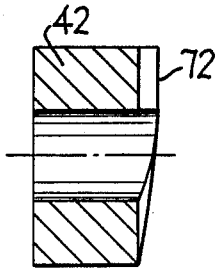
FIG. 9

TILT CONTROL MECHANISM, PARTICULARLY FOR KNEE-TILT CHAIR

FIELD OF THE INVENTION

This invention relates to an improved knee-type tilt control mechanism for a chair.

BACKGROUND OF THE INVENTION

Pedestal-type office chairs have conventionally utilized a tilt-type control mechanism connecting the upper end of the pedestal to the chair seat. This control mechanism defines a substantially horizontal tilt axis which extends sidewardly across the chair directly adjacent the underside thereof, with the tilt axis being disposed substantially directly over the pedestal and hence disposed substantially midway between the front and rear edges of the chair seat. With this mechanism, rearward tilting of the chair seat results in the rear edge of the seat swinging downwardly, and simultaneously the front edge of the chair seat lifts upwardly causing undesired lifting of the occupant's legs in the vicinity of the knees. Tilt control mechanism of this type have long possessed this recognized disadvantage, but have nevertheless been extensively utilized in view of the difficulties in resolving this problem.

In recent years chair manufacturers have succeeded in developing a knee-tilt control mechanism. This mechanism again connects to the upper end of the pedestal but is positioned forwardly therefrom, whereby the sidewardly extending horizontal tilt axis is hence disclosed more closely adjacent the front edge of the chair seat. In this manner, rearward tilting of the seat structure is accomplished solely by a downward tilting of the rear edge of the seat, with the front edge of the seat experiencing only minimal elevational change. The occupant can thus experience tilting of the seat structure without encountering undesired lifting of the legs away from the floor.

The design of a proper knee-tilt mechanism has presented several formidable problems since such mechanism has to be cantilevered forwardly from the upper end of the pedestal, and at the same time the mechanism must be disposed within a package which does not ruin the appearance of the chair.

Most attempts to provide a knee-tilt mechanism have employed a spring-type restoring device using torsion or compression springs, the latter cooperating with levers or a linkage for continually urging the seat structure upwardly into its normal horizontal position when unoccupied. These spring-type restoring devices have, for the most part, created a restoring force which substantially linearly increases as the tilt angle increases, the latter typically being a minimum of about 16° downwardly from the horizontal. Because of the substantially linear relationship of the restoring force, the known mechanism have possessed disadvantages which have made use of these mechanisms, and the use and comfort of the chairs employing them, less than desired.

For example, the known knee-tilt mechanisms have normally employed a substantially linear restoring spring arrangement which possesses a spring rate such that the restoring force increases significantly as the seat structure is tilted backwardly. This significant increase in the spring force is required so as to support the chair occupant and counterbalance the backward tilt. If a low initial torque and low spring rate are used, it has been observed that when the occupant initially sits in the chair, the weight of the occupant itself causes the seat structure to tilt backwardly through a substantial extent, such as up to about 10°. This has been observed to be an undesirable degree of tilt for supporting the occupant, since a rearward tilt in the range of 3° to 5° is preferred under such circumstance. This larger tilt is undesirable since it detracts from the chair comfort when working at a desk or table.

To overcome this latter problem, several different structures have been tried. The primary attempt has involved the use of a mechanical lock which is manually controlled by the chair occupant. That is, the knee-tilt mechanism is maintained with a spring mechanism having properties of the type explained above, and in addition the mechanism is provided with a manually controlled mechanical lock. This lock is normally activated by the occupant and, in effect, results in the chair seat being fixed in its upright position, that is, the seat being oriented substantially horizontally. When tilting of the seat is desired, the occupant has to release the mechanical lock so that the tilt mechanism then permits rearward tilting of the chair seat. Needless to say, the provision of this mechanical lock greatly detracts from the comfort and flexibility of the chair since the occupant must basically always be converting the chair from a fixed to a tilt condition, or vice versa, and this manual manipulation obviously detracts from the desirability of the chair.

In other attempts to overcome this problem, other variations of the tilt mechanism have used a higher spring rate, and/or have increased the initial restoring force (i.e., the precompression or pretorque) of the spring which maintains the unoccupied seat structure in its horizontal position. Increasing the spring rate and/or initial restoring force thus tends to counteract the initial weight of the occupant. These changes, however, also cause the linear relationship of the restoring force to be increased or shifted upwardly throughout the complete tilt range so that, when a person attempts to tilt the chair seat backwardly throughout substantially its full range, it has been observed that many occupants are unable to exert (at least comfortably) sufficient force so as to permit rearward tilting of the chair throughout substantially the full tilt angle. Under this circumstance, the chair occupant again finds the chair highly uncomfortable due to the inability to comfortably tilt backwardly the full extent, and due to the excessively large restoring force which the occupant must overcome.

Accordingly, it is an object of this invention to provide an improved knee-tilt control mechanism for a chair, which mechanism is believed to overcome many of the disadvantages which have been associated with prior structures as explained above. The knee-tilt control mechanism of this invention is particularly of the passive type in that it does not require any change or action by the occupant, but rather permits automatic reclining when desired.

More specifically, it is an object of this invention to provide an improved knee-tilt control mechanism for a chair, which control provides a substantially nonlinear restoring force throughout the angle of tilt so as to provide adequate stiffness and restoring force to maintain the chair seat at a desired position under normal use conditions with an occupant therein, while at the same time permitting the chair to be tilted rearwardly throughout substantially its full range without generating excessively large restoring forces which make tilting difficult or uncomfortable. In the improved knee-tilt control, the nonlinear restoring force preferably includes a linearly increasing restoring force over the initial range of tilt such as from the 0° position to about the 5° position, with the restoring force thereafter being substantially linear but at a lesser rate so as to prevent the maximum restoring force at the full tilt angle from reaching an excessive magnitude.

In the improved mechanism of this invention, as aforesaid, the initial restoring force, and the increasing restoring force as the chair seat tilts rearwardly due to the weight of the occupant, is such as to maintain the chair seat at only a small rearward tilt angle with respect to the horizontal, such as a maximum tilt angle of about 3° to 5°, so as to hence maintain an optimum seating position for the occupant. At the same time, rearward tilting of the seat throughout its full range can be easily accomplished, even by a person of rather light weight, without encountering excessive restoring force which makes such tilting uncomfortable or impossible.

A further object is to provide an improved mechanism, as aforesaid, which is relatively compact and hence can be structurally and properly designed so as to be positioned directly under the front portion of the chair seat without detracting from the overall esthetics or appearance of the chair. This improved mechanism also possesses the capability of permitting the initial restoring force or torque to be selectively adjusted without requiring any complex adjustment function or disassembly of the mechanism.

According to the present invention, the seat structure and pedestal of a chair are joined together by a knee-tilt control mechanism which includes a first support which is fixed to and projects downwardly from the underside of the chair seat adjacent the front edge thereof, and a second support which is fixed to the upper end of the pedestal and projects forwardly therefrom so as to terminate in a generally sidewardly extending tube structure. The first support has a pair of bearing hubs at opposite ends thereof which are rotatably engaged with the tube structure so as to define a horizontal tilt axis which extends sidewardly of the chair seat and is disposed closely adjacent the underside thereof in close proximity to the front edge. A spring-type restoring mechanism is disposed substantially within the tube structure and coacts between the first and second support for exerting a restoring moment which continuously urges the chair seat upwardly into a substantially horizontal position. The restoring mechanism employs a pair of compression springs, such as stacks of Belleville springs, disposed within the tube structure on axially opposite sides of an adjustable pre-torque member which can be selectively rotated so as to set the initial compression level of the springs. The outer ends of the springs bear against actuator members which are coupled to and rotate with the bearing hubs of the first support. The actuators have radially outwardly projecting cam followers for engagement with ramp-like cams which are formed on the tubelike structure and extend circumferentially thereof through the permissible tilt angle. When the seat structure is tilted rearwardly causing rotation of the first support and hence corresponding rotation of the actuators and cam followers, the cam followers ride against the cam ramps and cause the actuators to be displaced axially inwardly to increase the compression of the springs in accordance with the profile on the cams. The cams have a nonlinear profile so that the displacement of the actuator and corresponding compression of the springs increase at a first rate throughout the initial tilt angle, such as from 0° to 5°, with the cam ramp then being of lesser slope so that the rate of axial displacement and corresponding rate of spring compression hence decreases throughout the remaining angular tilt of the seat structure.

Other objects and purposes of the invention will be apparent upon reading the following specification and inspecting the accompanying drawings.

DESCRIPTION OF THE DRAWINGS

FIGS. 4 and 5 are sectional views taken substantially along lines IV—IV and V—V, respectively, in FIG. 3.

FIG. 6 is an end view of the adjusting gear, and FIG. 7 is a sectional view thereof as taken substantially along line VII—VII in FIG. 6.

FIG. 8 is an end view of the adjusting sleeve, and FIG. 9 is a sectional view thereof as taken substantially line IX—IX in FIG. 8.

FIG. 10 is an enlarged fragmentary view illustrating the relationship, between the cam follower and cam slot.

FIG. 11 diagrammatically illustrates, substantially on a flat plane, the approximate profile of the cam so as to provide a restoring force which possesses a nonlinear relationship when considered throughout the full range of tilt.

FIG. 12 diagrammatically illustrates the relationship between torque and tilt angle.

Figure 1:
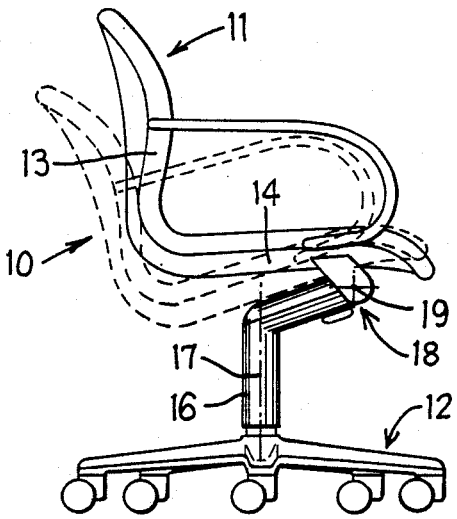
FIGS. 1 and 2 diagrammatically illustrate side and front elevational views, respectively, of a pedestal-type chair employing the improved knee-tilt control mechanism of this invention.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the chair and designated parts thereof. Said terminology will include the words specifically mentioned, derivatives thereof, and words of similar import.

DETAILED DESCRIPTION

Figure 2:
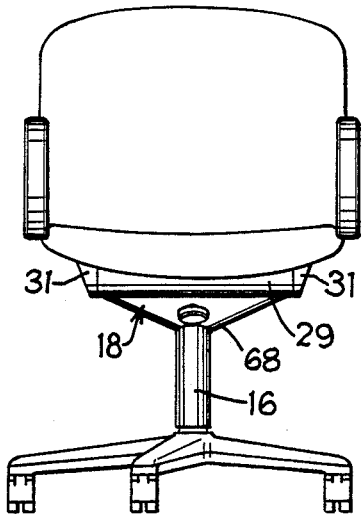

FIGS. 1 and 2 illustrate a pedestal-type chair 10 having a seat structure 11 supported on a pedestal-type base assembly 12. The seat structure 11 includes a back 13 integrally joined to a seat 14, although the seat and back could be separate as is conventional. The base assembly 12 includes a wheeled five-star base which is generally conventional and has a central pedestal 16 projecting vertically upwardly therefrom, which pedestal defines a vertical swivel axis 17 which intersects approximately at the center of the seat 14.

In the improved chair of the present invention, the pedestal 16 and seat 14 are joined together by a tilt control mechanism 18 of the knee type, which mechanism 18 defines a generally horizontally extending tilt axis 19 which extends transversely (i.e., sidewardly) of the seat 14 and is disposed in forwardly spaced relationship from the swivel axis 17 so as to be positioned more closely adjacent the front edge of the seat 14 while being disposed vertically directly thereunder.

The tilt mechanism 18 is spring biased so as to normally maintain the seat 14 in a substantially 0° tilt (i.e. zero tilt) position as illustrated by FIG. 1, in which position the seat 14 extends approximately horizontally from front-to-back. Under load, however, such as created by an occupant sitting in the chair, the seat 14 (and in fact the entire seat structure 13) tilts backwardly and downwardly about the tilt axis 19 through a limited tilt angle as diagrammatically illustrated by dotted lines in FIG. 1. This tilt angle, so as to place the seat 14 in its maximum or full tilt position, is normally in the range of from about 16° to about 26°.

The tilt control mechanism 18 includes a housing structure 21 which is mounted on the upper end of the pedestal 16 and projects forwardly therefrom, which housing structure in turn rotatably supports thereon a support structure 22 for relative tilting about the axis 19. This support structure 22 in turn is fixedly secured to the frame (not shown) which is disposed internally of the seat 14, with the support structure 22 projecting downwardly below the bottom shell or pan which encloses the seat 14. A spring-type biasing means 23 coacts between the housing structure 21 and the support structure 22 for imposing a biasing or restoring torque on the support structure 22, and hence on the seat 14, so as normally maintain the latter in the horizontal or zero-tilt position. A pretorque adjusting means 24 cooperates with the biasing means 23 for defining a base or initial torque which continuously acts against the support structure 22 and seat 14 so as to maintain it in its zero-tilt position.

Considering now the details of the tilt control mechanism 18, the housing structure 21 includes generally parallel top and bottom cover plates 26 and 27 which are approximately of triangular shape and are rigidly joined together at their apex so as to define a hub 28, the latter being telescoped over the upper end of the pedestal 16. The housing 21 projects forwardly from this hub 28 toward the front free edge of the seat 14, and the forward edges of the plates 26–27 are rigidly joined to a horizontally elongated tube 29 which extends transversely relative to the seat slightly therebelow and spaced inwardly a small distance from the front edge thereof. This tube 29 defines the tilt axis 19 and hence is spaced forwardly a substantial distance from and in nonintersecting relationship to the swivel axis 17.

The support structure 22 is pivotally or hingedly supported on the housing structure 21, and for this purpose includes a pair of mounting brackets 31 which have parallel upper plate portions 32 which are sidewardly spaced apart and disposed within the interior of the seat 14, these plate portions 32 being rigidly secured to the interior frame (not shown) of the seat. The plate portions 32 extend approximately horizontally when in the zero-tilt position, and at their outer edges are provided with downwardly projecting arms 33, the latter terminating in inwardly opposed and coaxially aligned cylindrical hubs 34 which are rotatably received within the opposite ends of the tube 29. The hubs 34 are nonrotatably fixed to opposite ends of a shaft 36 which extends through tube 29 along the axis 19.

Considering now the biasing means 23, it includes a pair of substantially identical springs 41 which are confined axially within the tube 29. Each spring 41 has the inner end thereof seated against a pretorque actuator sleeve 42, the latter being described hereinafter. The spring 41 in the illustrated embodiment is preferably formed by a plurality of conical spring washers (also known as Belleville springs) disposed with two such springs stacked together, with several such stacks being disposed in series, as illustrated by FIG. 4. Forming the spring 41 from conical spring washers is highly desirable since a high spring force can be generated within an extremely small space, and the spring is capable of generating an extremely high spring rate (that is, change in force relative to change in distance or compression). However, it will be appreciated that other types of compression springs can also be utilized so long as they can be designed so as to fit within a small compact package while at the same time yielding the required high spring rate.

The other or outer end of each spring 41 is seated against an annular flange 43 which is associated with one end of a sleeve bearing 44, the latter being nonrotatably secured to the shaft 36. This sleeve bearing 44 is in turn surrounded by and nonrotatably coupled to a torque actuator sleeve 46 which is rotatably disposed within the tube 29, this torque actuator sleeve 46 also being nonrotatably coupled relative to the adjacent hub 34 of the support structure 22. The provision of the bearing 44, however, enables the bearing sleeve 44 and the surrounding actuator sleeve 46 to be axially displaced relative to the shaft 36.

The actuator sleeve 46 has a radially-outwardly projecting cam follower 47 mounted thereon, which cam follower 47 in the illustrated embodiment is formed as a headed bolt or pin. The cam follower 47 projects outwardly through a cam slot 48 formed through the wall of the surrounding tube 29. This cam slot 48, in the illustrated embodiment, is formed in a separate insert plate 49 which is fixed to the tube 29 so as to provide increased wall thickness. A roller or needle bearing 51 surrounds the cam follower 47 where it projects through the cam slot 48 so as to facilitate the movement of the cam follower along the slot.

Figure 3:
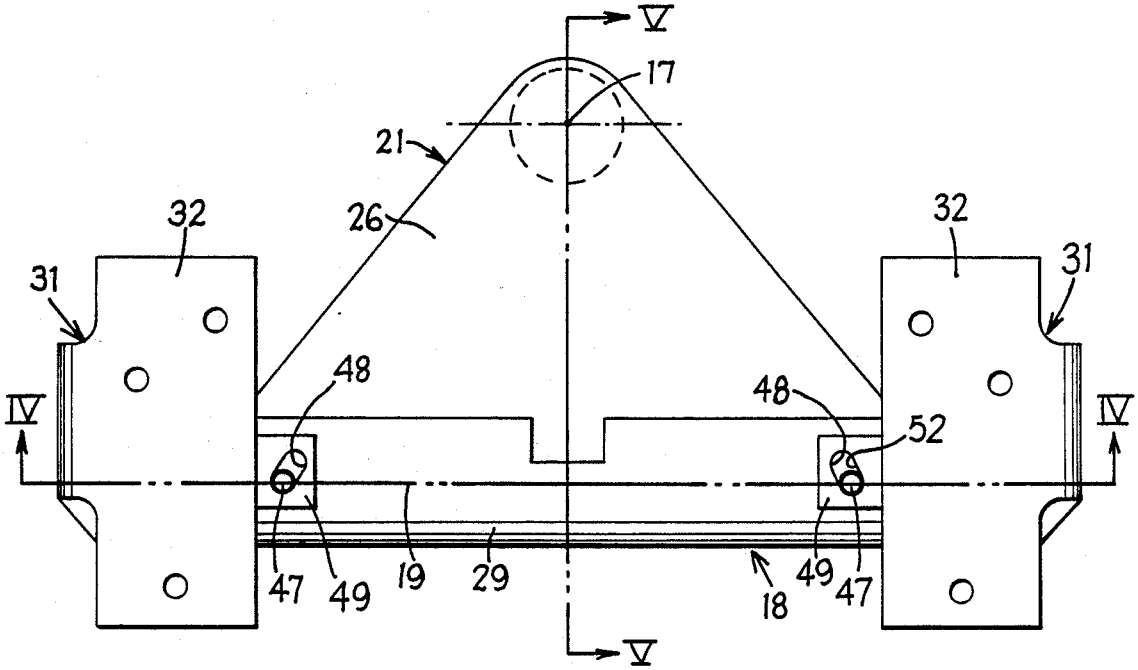
FIG. 3 is a plan or top view illustrating the knee-tilt mechanism removed from the seat structure of the chair.

The bearing of the outer end of the spring 41 against the flange 43 urges this latter flange against the inner axial end face of the actuator sleeve 46, and this in turn urges the cam follower 47 thereon against the outer sidewall of the cam slot 48, and normally maintains the cam follower 47 in abutting engagement with the inner end of the cam slot as illustrated by FIG. 3, this being the typical zero-tilt position.

Cam slot 48, as illustrated by FIGS. 3 and 10, is sloped or angled relative to the circumferentially extending direction of the tube 29 so that one side 52 of the slot 48 hence defines a cam surface which reacts against the follower 47 during rearward tilting of the chair seat. This cam surface 52, as it extends from the zero-tilt position to the maximum tilt position of the chair seat, is nonlinear so as to cause a greater increase in the spring force and hence the restoring torque during the initial tilt of the chair (such as from the zero-tilt position to an intermediate position such as an approximately 5° tilt angle), with the restoring spring force and hence torque increasing at a lesser rate throughout the remainder of the tilt angle (that is, from about 5° to the full tilt angle of 16° to 26°). This nonlinear relationship is created by making the cam surface 52 nonlinear and, for this purpose, the surface 52 may be formed in the manner which has been diagrammatically illustrated by FIG. 11.

More specifically, the cam surface 52 includes a first linear surface portion 53 which extends from the zero-tilt position to an intermediate position which is normally in the neighborhood of about 5°. This initial or first cam surface part 53 hence has the steepest slope relative to the circumferential direction, and hence defines a greater spring rate inasmuch as each degree of rotation of the actuator sleeve 46 and follower 47 causes a significant compression of the spring 41 due to the follower 47 and actuator 46 being cammed axially inwardly as the follower 47 reacts against the cam surface portion 53. When the follower 47 reaches the intermediate location defined by the transition between the cam surface portions 53 and 54, which transition portion is normally smoothly curved, the cam follower 47 then moves into engagement with the cam surface portion 54, the latter extending at a lesser slope or incline relative to the circumferential direction. Hence, for each degree of rotation of the sleeve 46 when the follower 47 engages the cam surface portion 54, the axial displacement of the sleeve 46 and hence the corresponding compression of the spring 41 is a lesser amount. Hence, this cam surface portion 54 continues to effect compression of the spring and hence increases the restoring torque but does so at a lessor rate.

This variable restoring relationship throughout the angle of tilt is diagrammatically illustrated in FIG. 12. Assuming that an initial restoring torque $T_i$ exists at the 0° position, then as the cam follower 47 moves outwardly along the cam surface portion 53, the torque increases along the line $T_{53}$ until reaching the intermediate position which is the transition between cam surfaces 53 and 54, this normally being about 5°. As the follower 47 then moves outwardly along cam surface 54 due to continued tilt of the chair seat, which tilt can be progressively increased from 5° up to the full tilt angle, then the restoring torque continues to increase but does so at a slower rate as diagrammatically illustrated by the torque $T_{54}$. Hence, when reaching a full tilt position, the maximum restoring torque has been minimized, and thus the chair occupant does not have to make as strenuous an effort in order to fully tilt the chair backwards into the maximum tilt position. At the same time, however, the initial tilt up to at least the transition point of about 5° still results in the tilt back encountering a significantly increased resistance, and this hence avoids the person from accidentally tilting the chair backwardly through an excessive amount, but rather requires the chair occupant to deliberately increase the tilt force against the restoring force until at least passing through the transition point, following which further tilt back can be accomplished without increasing the tilting force at the same rate.

As to the initial pretorque $T_i$, this can be adjusted within limits so as to optimize user comfort, such as in accordance with the weight of the occupant. For this purpose, the tilt mechanism also includes the pretorque adjusting means 24. This latter means includes an adjusting sleeve 61 which in effect is formed as a gear and is disposed within the tube 29 axially between the pair of pretorque actuator sleeves 42. The adjusting sleeve 61 is independently rotatably supported on a bearing 62 which surrounds the shaft 36. The adjusting sleeve or gear 61 is disposed in continuous meshing engagement with a worm 63 which is disposed within the interior of the housing 21 and projects through an opening or recess in the tube 29 so as to meshingly engage the gear. Worm 63 is nonrotatably secured to a shaft 64 which projects transversely of the plates 26–27. This shaft 64 is rotatable and defines an axis of rotation for the worm 63 which extends perpendicularly with respect to the rotational axis 19 of the gear 61. Shaft 64 is rotatably supported on a U-shaped bracket 66 which is disposed between the plates 26–27, the bracket being fixedly secured to a partition 67 which is fixed to and projects downwardly from the top plate 26. The lower end of shaft 64 projects through the bottom plate 27 and has a knob or handle 68 secured thereto so as to permit manual rotation of the worm 63 when desired. Rotation of worm 63 by handle 68 causes a corresponding angular displacement of the gear 61, which gear can be selectively angularly rotated through an angle which approaches but is slightly less than 180° in the illustrated embodiment.

The adjusting sleeve or gear 61 has a cam structure 71 defined on the opposite axial faces thereof, which cam structure 71 cooperates with an opposed cam structure 72 formed on the opposed end of the respective pretorque actuator sleeve 42. These latter sleeves are basically nonrotatable with respect to the shaft 36 and tube 29, this being obtained either positively as by keys or due to frictional holding force created by the spring.

In the illustrated embodiment, the cam structure 71 on each axial end face of gear 61 is defined by a pair of arcuate ramps which connect head-to-tail, which ramps each extend through 180°. The ramps defining the cam structure 71 cooperate with the cam structure 72, the latter also being defined by a pair of ramps which extend through about 180° so that the opposed cams 71–72 hence always maintain two areas of contact which are substantially diametrically opposed.

By manually rotating the handle 68 in one direction so as to effect rotation of the gear 61 and of the cam structures 71, the ramps of the cam structure 71 hence slide upwardly along the ramps of the cam structures 72 and hence effect a slight outward displacement of the pretorque actuator sleeves 42 away from the gear 61. This hence causes the sleeves 42 to respectively move toward the opposed actuator sleeves 46 and hence cause an initial compression of the springs 41 so as to thus vary the initial force and thus the initial restoring torque $T_i$.

While the cam surface 52 as described above has been formed from two substantially linear cam profiles which combine so as to result in the overall cam surface 52 having a nonlinear relationship when considered from the zero-tilt to the maximum tilt position, it will be appreciated that the cam surface 52 cam be defined with a changing curvature throughout substantially its entire length if desired so long as such curvature provides a relatively high rate of increase in the restoring torque throughout the tilt from the zero-tilt to an intermediate position of about 5°, with the rate of restoring torque increasing (or possibly decreasing) throughout the remaining angle of tilt.

Inasmuch as the operation of the improved tilt mechanism of this invention and the advantages thereof have been explained in detail above, a further detailed explanation of the operation is hence believed unnecessary.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a pedestal-type chair having a base assembly provided with a vertically upwardly projecting pedestal thereon, a seat structure disposed adjacent the upper end of the pedestal, and a knee-type tilt mechanism operatively connecting the seat structure to the pedestal for permitting tilting of the seat structure relative to the pedestal about a substantially horizontally extending tilt axis which extends sidewardly of the seat structure and is disposed in close proximity to the front edge thereof, said tilt axis being positioned forwardly from and in nonintersecting relationship to a vertical axis defined by the pedestal, the knee-tilt mechanism including a housing structure which is mounted on the pedestal and pivotally supports thereon a support structure for relative tilt therebetween about the tilt axis, the support structure being fixedly secured to the seat structure, and spring means coacting between said housing and support structures for imposing a restoring torque on the seat structure which normally maintains the seat structure when unoccupied in a substantially zero-tilt position, said seat structure being tiltable rearwardly about the tilt axis relative to the pedestal through a predetermined maximum tilt angle, comprising the improvement wherein said knee-tilt mechanism includes means responsive to the tilt of said seat structure for causing the restoring torque to increase according to a first predetermined pattern as the seat structure moves from the zero-tilt position to an intermediate position and for thereafter causing the restoring torque to change according to a second predetermined pattern as the seat structure tilts from said intermediate position to said maximum tilt angle so that the restoring torque generated according to said second predetermined pattern is less than the restoring torque which would be generated if the first predetermined pattern was extended from said intermediate position to said maximum tilt angle, said responsive means including cam-and-follower means coacting between said housing and seat structure, said cam-and-follower means including a cam nonrotatably mounted on one of said structures and a follower nonrotatably mounted on the other of said structures, said follower being supported on said other structure for movement relative thereto along a direction which is generally parallel with said tilt axis, said spring means normally urging said follower into engagement with a cam surface which is defined on said cam, said spring means and said cam-and-follower means cooperating to cause said restoring torque to increase at a first rate per degree of tilt as the seat tilts from said zero-tilt position to said intermediate position, and said spring means and said cam-and-follower means cooperating to cause said restoring torque to increase at a second rate per degree of tilt as the seat structure moves from said intermediate position to said maximum tilt position, said second rate being substantially smaller than said first rate.

2. In a pedestal-type chair having a base assembly provided with a vertically upwardly projecting pedestal thereon, a seat structure disposed adjacent the upper end of the pedestal, and a knee-type tilt mechanism operatively connecting the seat structure to the pedestal for permitting tilting of the seat structure relative to the pedestal about a substantially horizontally extending tilt axis which extends sidewardly of the seat structure and is disposed in close proximity to the front edge thereof, said tilt axis being positioned forwardly from and in nonintersecting relationship to a vertical axis defined by the pedestal, the knee-tilt mechanism including a housing structure which is mounted on the pedestal and pivotally supports thereon a support structure for relative tilt therebetween about the tilt axis, the support structure being fixedly secured to the seat structure, and spring means coacting between said housing and support structures for imposing a restoring torque on the seat structure which normally maintains the seat structure when unoccupied in a substantially zero-tilt position, said seat structure being tiltable rearwardly about the tilt axis relative to the pedestal through a predetermined maximum tilt angle, comprising the improvement wherein said knee-tilt mechanism includes means responsive to the tilt of said seat structure for causing the restoring torque to increase according to a first predetermined pattern as the seat structure moves from the zero-tilt position to an intermediate position and for thereafter causing the restoring torque to change according to a second predetermined pattern as the seat structure tilts from said intermediate position to said maximum tilt angle so that the restoring torque generated according to said second predetermined pattern is less than the restoring torque which would be generated if the first predetermined pattern was extended from said intermediate position to said maximum tilt angle, said responsive means including cam-and-follower means coacting between said housing and seat structures and being relatively rotatable about said tilt axis, said cam-and-follower means including a cam nonrotatably mounted on one of said structures and a follower nonrotatably mounted on the other of said structures, said spring means normally urging said cam and follower into engagement with one another, said cam defining a cam surface which extends circumferentially with respect to said tilt axis through an angle at least substantially equal to said maximum tilt angle, said cam surface being nonlinear as it extends from said zero-tilt position to said maximum tilt angle and having a first cam profile which extends from said zero-tilt position to said intermediate location, said cam surface having a second cam profile which is different from said first cam profile and extends from said intermediate position to said maximum tilt angle.

3. A chair according to claim 2, wherein said first cam profile causes the restoring torque generated by said spring means to increase at a first rate per degree of tilt, and wherein said second cam profile causes the restoring force to increase at a second rate per degree of tilt, said second rate being substantially smaller than said first rate.

4. A chair according to claim 3, wherein said intermediate location is defined approximately 5° from said zero-tilt position, and wherein said maximum tilt angle is at least about 16°.

5. A chair according to claim 2, wherein one of said cam and follower is fixedly secured relative to its respective structure, and wherein the other of said cam and follower is nonrotatably but axially slidably movable relative to its respective structure.

6. An apparatus according to claim 5, wherein said housing structure includes a tube which extends concentric with said tilt axis, said cam being defined by a slot which projects through said tube, said follower including a follower part which projects into said cam slot and which is fixed to an actuator part which is nonrotatably secured with respect to the support structure but is axially slidably movable relative to said support structure in a direction generally parallel with said tilt axis.

7. A chair according to claim 6, wherein said actuator part is axially slidably disposed within said tube, said spring means being confined within said tube and having one end thereof disposed in bearing engagement with said actuator part for normally maintaining said actuator part in bearing engagement with said support structure when in said zero-tilt position.

8. A chair according to claim 7, including adjustment means coacting with the other end of said spring means for permitting selective manual adjustment of the position thereof to vary the initial compression of said spring means and hence the initial restoring torque when in said zero-tilt position.

9. In a pedestal-type chair having a base assembly defining thereon a pedestal which projects vertically upwardly in cantilevered fashion, a seat structure having both a seat and a back, the seat being disposed directly above the pedestal so that the latter has its vertical centerline intersecting the seat adjacent the midpoint thereof, and a knee-tilt mechanism connected between the pedestal and seat and defining a substantially horizontally-extending tilt axis which extends sidewardly relative to the seat in the vicinity of the front edge thereof for permitting the seat to be tilted downwardly about the tilt axis from a substantially zero-tilt position through a maximum tilt angle to a lower tilt position, said tilt axis being disposed a substantial distance forwardly from and in nonintersecting relationship to the vertical centerline of said pedestal, the improvement wherein said tilt mechanism comprises:

a housing structure mounted on said pedestal adjacent the upper end thereof and projecting forwardly therefrom toward the front edge of said seat;

a support structure secured to said seat and projecting downwardly therefrom adjacent but spaced slightly rearwardly from the front edge thereof;

one of said structures including a horizontally elongated tube extending substantially concentrically of said tilt axis, and the other of said structures including a pair of opposed hub parts which rotatably supportingly engage said tube adjacent the opposite ends thereof for permitting relative tilting between said structures about said tilt axis;

a pair of actuators disposed adjacent opposite ends of said tube, said actuators being nonrotatably connected to the respectively adjacent hub part but being axially slidable relative thereto;

spring means coacting with said actuators for urging said actuators axially into locations corresponding to said zero-tilt position; and cam-and-follower means coacting between said tube and said actuators for causing said actuators to be slidably moved axially away from their respective locations to effect compression of said spring means in response to angular tilting of the seat about the tilt axis away from said zero-tilt position.

10. A chair according to claim 9, wherein said cam-and-follower means defines a cam profile which is nonlinear as it extends from said zero-tilt position to said lower tilt position for causing compression of the spring means at a first rate during tilt from said zero-tilt position to an intermediate position and for causing compression of the spring means at a second rate which is less than said first rate during tilt from said intermediate position to said lower tilt position.

11. A chair according to claim 10, wherein said spring means is disposed within said tube and acts axially therealong, said actuators are disposed within said tube adjacent the opposite axial ends thereof, each said actuator is axially confined between its respective hub part and said spring means, and said cam-and-follower means including a follower which is fixed to said actuator and projects radially therefrom into slidable engagement with a cam slot formed in said tube.

12. A chair according to claim 11, including adjustment means for adjusting the initial compression of said spring means when the mechanism is in said zero-tilt position, said adjustment means including a rotatable adjustment member rotatably positioned within said tube, said spring means including a pair of separate springs disposed axially on opposite sides of said adjustment member, and a pair of axially-movable adjusting elements disposed on axially opposite sides of said adjustment member so as to be interposed between the adjustment member and the adjacent ends of the springs, the adjustment member and the adjusting elements having axially-directed cam means coacting therebetween for changing the axial position of the adjusting elements in response to rotation of the adjusting member.

* * * * *